US007815490B2

(12) United States Patent
Liu

(10) Patent No.: US 7,815,490 B2
(45) Date of Patent: Oct. 19, 2010

(54) FLASH VAPORIZING WATER JET AND PIERCING WITH FLASH VAPORIZATION

(75) Inventor: Peter Liu, Bellevue, WA (US)

(73) Assignee: OMAX Corporation

( * ) Notice: Subject to any disclaimer, the term of this patent is extended or adjusted under 35 U.S.C. 154(b) by 434 days.

(21) Appl. No.: 11/818,272

(22) Filed: Jun. 13, 2007

(65) Prior Publication Data

US 2008/0060493 A1 Mar. 13, 2008

Related U.S. Application Data

(60) Provisional application No. 60/843,806, filed on Sep. 11, 2006.

(51) Int. Cl.
*B24B 49/00* (2006.01)

(52) U.S. Cl. ..... 451/7; 451/53

(58) Field of Classification Search ..... 451/7, 451/53

See application file for complete search history.

(56) References Cited

U.S. PATENT DOCUMENTS 4,937,985 A * 7/1990 Boers et al. ..... 451/75
2004/0147204 A1* 7/2004 Sakai ..... 451/2

FOREIGN PATENT DOCUMENTS

JP 2003/266312 A2 9/2003

OTHER PUBLICATIONS

English translation of JP 2003/266312 A2.*
"Critical Temperture and Pressure" http://www.chem.purdue.edu/gchelp/liquids/critical.html.*
Liu, H.-T., Fang, S., and Hibbard, C. (1999) "Enhancement of Ultrahigh-Pressure Technology with LN2 Cryogenic Jets," Proc. 10th Amer. Waterjet Conference, Houston, Texas, Aug. 14-17.
Dunsky, C. M., Hashish, M. and Liu, H.-T. (1997) "Development of a Vanishing Abrasive Cryogenic Jet (VACJET)" Proc. 1997 DOD/Industry Aerospace Coatings Conf., Las Vegas, Nevada, May 13-15.
Liu, H.-T., and Bulter, T. (1998) "A Vanishing Abrasive Cryogenic Jet for Airframe Depainting" Proc. 14th In. Con. on Jetting Technology, Brugge, Belgium, Sep. 21-23, pp. 519-533.
Dunsky, C. M., and Hashish, M. (1994a) "Feasibility Study of Machining with High-Pressure Liquefied CO2 Jets," Proceedings of Symposium on Nontraditional Manufacturing Processes in the 1990s, Chicago, ASME, Quest Technical Paper No. 332.
Dunsky, C. M., and Hashish, M. (1995) "Feasibility Study of the Use of Ultrahigh-Pressure Liquefied Gas Jets for Machining of Nuclear Fuel Pins," Proceedings of the 8th American Waterjet Technology Conference, Houston, Texas, Aug. 26-29, pp. 505-517.
Dunsky, C. M., and Hashish, M. (1996) "Ultrahigh Pressure Cryogenic Jet Cutting Steel", U. S. Department of Commerce, Quest Technical paper No. 697.
Miller, D. S., (2005) "New Abrasive Waterjet Systems to Compete with Lasers" WJTA American Waterjet Conference; Houston, Texas, Aug. 21-23.
International Search Report; Apr. 3, 2008.

* cited by examiner

*Primary Examiner*—Maurina Rachuba
(74) *Attorney, Agent, or Firm*—Christopher A. Wiklof; Graybeal Jackson LLP

(57) ABSTRACT

A flash vaporizing liquid jet cutting tool and method for piercing with minimal damage to the cut material. The liquid is preferably superheated water, typically with abrasive particles added after the jet is expressed through a nozzle (abrasive water jet, AWJ) or with abrasive particles added before the jet is expressed through a nozzle (abrasive slurry jet, ASJ). In piercing, only a portion of water that has not changed phase enters into the cavity or must leave the cavity and the piercing pressure, which can damage the material, is therefore reduced.

27 Claims, 2 Drawing Sheets

FLASH VAPORIZING WATER JET AND PIERCING WITH FLASH VAPORIZATION

This application claims priority (with insignificant added new matter) from U.S. provisional application 60/843,806 filed on Sep. 11, 2006, the contents of which are incorporated by this reference.

BACKGROUND

In hole drilling or slot machining, it has been discovered that the essentially incompressible jet of the abrasive water jet and the abrasive slurry jet (AWJ/ASJ) builds up an extremely high piercing pressure at the bottom of the blind hole or slot (hereafter referred to as the cavity) before break through. The piercing pressure build up is a direct consequence of deceleration and reversal of the AWJ as the bottom of the cavity is approached. For delicate target materials such as composites and laminates, surface/subsurface damages and delamination may result when the piercing pressure exceeds the tensile strength of the materials or the binding strength of the adhesive of the laminates. Furthermore, the large difference in the density between the water and abrasives lead to a lag of the abrasives' trajectories behind the streamline of the water as the return slurry turns around and reverses its course at the bottom of the cavity. In the return slurry, the spent abrasives that still possess considerable erosive power are forced toward the wall of the cavity, particularly near the cavity entrance where the slurry exits. As a result, the spent abrasives (typically 12% by weight and 3% by volume) are forced toward the wall of the cavity and induce excessive wear on the wall near the cavity entrance, leading to nonuniformity in the hole diameter.

Recent development of abrasive slurry jets or abrasive suspension jets (ASJ) by directly pumping an abrasive slurry through a nozzle has further improved the erosive power the UHP technology. It has demonstrated that under identical hydraulic and abrasive conditions, the two-phase ASJ consisting of water and abrasives has erosive power up to five times higher than that of the three-phase AWJs consisting of water, air, and abrasives. Evidently, the momentum transfer from the ultrahigh-speed water is more efficient in the ASJ with direct pumping of the slurry than in the AWJ with entrainment of abrasives downstream of the jet orifice. At present, the maximum pressure used in commercial ASJ systems is limited to 15,000 to 20,000 psi (103 to 138 MPa) due to lack of materials capable of resisting the erosive power of the ASJ at pressures higher than the above range. With the advent of development of advanced materials, ASJs operating at pressure comparable to that of AWJs are expected to become a superior machine tool to AWJs for various applications. However, the ASJ would be more problematic than the AWJ in terms of surface/subsurface damage. Because of the lack of entrained air in the two-phase slurry of the ASJ, the ASJ jet material will be less compressible than that of the three-phase slurry of the AWJ, creating still higher piercing pressures because they are proportional to the incompressibility of the fluid inside a blind cavity. Therefore using flash vaporization of the jet is even more effective in an ASJ than in an AWJ for mitigating surface/subsurface damage of delicate materials.

For hydroscopic materials where the use of water jets is undesirable or unacceptable, a UHP abrasive cryogenic jet (ACJ) using liquefied nitrogen ($LN_2$) as the working fluid has been developed for coating removal and machining advanced/delicate materials. One of the key differences of AWJs/ASJs and ACJs is that the $LN_2$ in ACJs changes phase after exiting the mixing tube whereas water in AWJs/ASJs does not. When drilling holes or slots into a target material to form a cavity, the cavity size increases with time by the erosive action of the abrasives. As the ACJ jet is entering the cavity, the $N_2$ gas evaporated from the liquid $N_2$ escapes easily from the cavity. As a result, the piercing pressure of the ACJ inside the cavity is considerably weaker than that of the AWJ/ASJ. Surface/subsurface damages are mitigated provided the reduced piercing pressure is weaker than the tensile strength of the materials or the binding strength of the adhesive of the laminates. As the $LN_2$ entering the cavity continues changing into $N_2$, the return flow consists mostly of dry abrasives and gas instead of a slurry as in the AWJ/ASJ. In other words, the return flow is considerably less organized and coheres less for the ACJ than for the AWJ/ASJ. The trajectories of the return spent abrasives in the ACJ are random in nature as they collide with the incoming abrasives and the side wall on their way out. The benefits of the phase change of the working fluid are therefore to mitigate surface/subsurface damage by reducing the piercing pressure inside the cavity and minimize nonuniform secondary damage by transforming the return flow from an abrasives slurry with liquid to dry abrasives and gas.

Although the advantages of ACJs over AWJs/ASJs for machining delicate materials have been demonstrated, there is considerable trade off in terms of economical and technical issues to be overcome before ACJs can be commercialized as a machine tool. ACJs are bulky, expensive to maintain, and difficult and hazardous to operate. First of all, the $LN_2$ requires a very large cryogenic storage and delivery facility. To ensure that no phase change takes place inside the UHP pump, an inline subcooler is often required just upstream of the pump to lower the temperature of the $LN_2$. The cryogenic temperature presents an extremely hostile environment to components such as the seals and valves of the pump and significantly reduces their operating life. Equally import, the spent $LN_2$ and $N_2$ must be vented properly to prevent unacceptable dilution of the $O_2$ in the work space.

SUMMARY OF THE INVENTION

The invented system emulates the phase changing characteristics of the abrasive cryogenic jet (ACJ) with a flash vaporizing abrasive water jet (AWJ) or abrasive slurry jet (ASJ) (FAWJ/FASJ) by superheating the water in a AWJ/ASJ. The superheated water flashes and changes into steam as soon as the jet exits the mixing tube. As a result, only a portion of water that has not changed phase enters into the cavity or must leave the cavity and the piercing pressure is therefore reduced. As the superheated water in the AWJ/ASJ continues evaporating into steam after entering the cavity, the return flow consists of wet abrasives and gas rather than a slurry of abrasives and liquid. Unlike a returning liquid slurry, the wet abrasives are not forced by the incoming stream toward the wall of the cavity on their way out. The flow characteristics of the FAWJ/FASJ inside the cavity are similar to that of the ACJ. Consequently, the FAWJ/FASJ achieves the benefits of the ACJ in terms of mitigating surface/subsurface damage and minimizing nonuniform secondary damage to the side wall of the cavity. The key advantage of the FAWJ/FASJ over the ACJ is that superheating the water in the AWJ can be achieved readily with inexpensive and simple set ups such that the FAWJ/FASJ will be considerably more portable and cost effective and safer to operate and maintain than the ACJ.

In one aspect, the invention is a jet cutting jet system using a hot liquid where a portion of the jet vaporizes after exiting a nozzle. The system includes a reservoir containing a liquid fluid that is a liquid in a range of 0 degrees C. to 50 degrees C. and earth atmospheric pressures; coupled to, such that the fluid may flow into a pump that pressurizes the fluid to a pressure sufficient keep the fluid in liquid form at a temperature that would produce a gas within the range of earth atmospheric pressures; coupled to, such that the fluid may flow into a nozzle which allows the fluid to be expressed in a jet into an atmosphere at a pressure within the range of earth atmospheric pressures. The system further comprises a heater that heats the fluid to a temperature that would produce a gas in the range of earth atmospheric pressures such that a portion of the fluid vaporizes after exiting the nozzle.

The fluid may be water. The system may further comprise an abrasive supply system that adds abrasive particles to the fluid before the jet strikes a workpiece. The system may further comprise a secondary nozzle that accelerates the fluid jet with propulsion provided by expansion of the fluid as a portion of it vaporizes. The heater may be coupled between the pump and the nozzle or between the pump and the reservoir or may be placed to heat the jet after it exits the nozzle and before it strikes a workpiece. The heater may heat the workpiece which heats the jet as it strikes the workpiece.

In another aspect the invention is a method in a jet cutting system for reducing lateral pressure on side walls of cuts when making piercing cuts by using a vaporizing jet. The method comprises having a jet cutting system like the one described above, operating the system with a fluid that is a gas in the range of earth atmospheric pressures such that a portion of the fluid vaporizes after exiting the nozzle, and using the system and the fluid to make a piercing cut in a workpiece.

This method may be employed with a system that further comprises an abrasive supply system that adds abrasive particles to the fluid before the jet strikes the workpiece. The system may further comprise a secondary nozzle that accelerates the fluid jet with propulsion provided by expansion of the fluid as a portion of it vaporizes. The fluid may be a gas when above 0 degrees C. at earth atmospheric pressures and may comprise molecules of two nitrogen atoms. The fluid may be a liquid in a range of 0 degrees C. to 50 degrees C. and earth atmospheric pressures, such as water, and the system may further comprise a heater that heats the fluid to a temperature that would produce a gas in the range of earth atmospheric pressures such that a portion of the fluid vaporizes after exiting the nozzle.

DETAILED DESCRIPTION

A FAWJ/FASJ may use any of several methods, either applied individually or combined, to superheat the water in the AWJ/ASJ. The temperature of the water must be sufficiently high to cause the water to evaporate or flash soon after the FAWJ/FASJ exits the mixing tube, similar to the $LN_2$ in the ACJ. The optimal locations at which the water of the FAWJ/FASJ flashes depends on the required enhancement for various machining applications.

In one embodiment, the temperature measured with a thermocouple attached to the nozzle was between 180 to 200 degree C. when the effects of mitigating of piercing damage in many delicate materials were demonstrated at 40 ksi (276 MPa) pressure upstream of the nozzle. The objective is to raise the temperature sufficiently high to reduce the piercing pressure to below the tensile strength of the materials or the binding strength of laminates. In practice, it is desirable to minimize the electrical power required to superheat the water. Tests suggest that the preferred temperature is be around 250 degree C. for most materials. At that temperature, most of the superheated water would be evaporated before entering into the blind hole. In rapid heating the water through a steel high-pressure tube, we must limit the temperature of the high-pressure tube to 600 degree F. such that the strength of the stainless steel would not be compromised.

Figure 1:
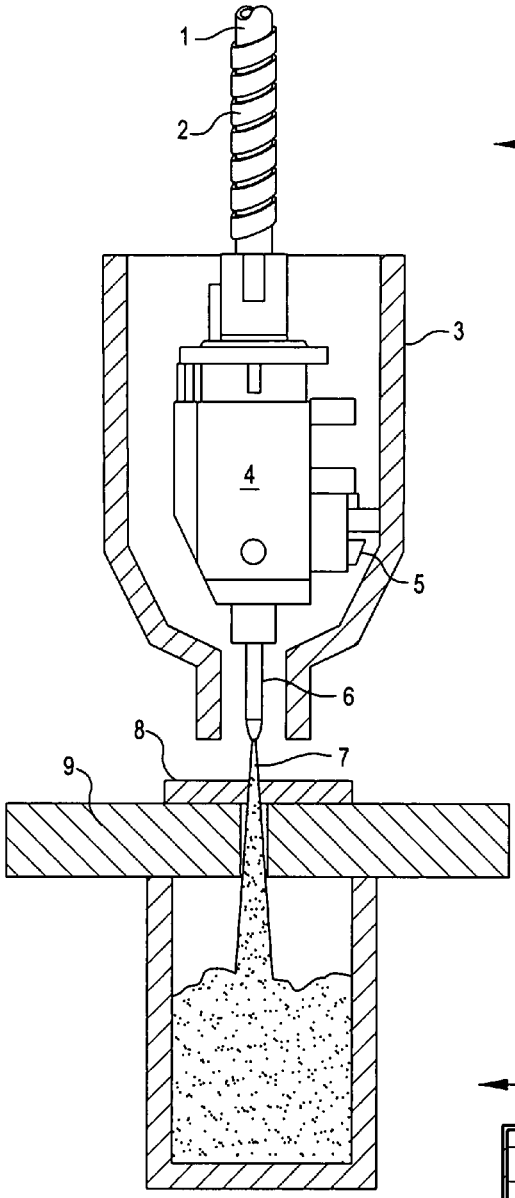
FIG. 1 shows a typical FAWJ which operates by superheating the water between the pump and the nozzle exit.

FIG. 1 is a sketch of a typical FAWJ which operates by superheating the water between the ultra high pressure (UHP) pump and the nozzle exit, which is just upstream of the abrasive feed port 5. Similar methods may be used for the FASJ. The difference between the two is that, in the abrasive slurry jet, a slurry of water and abrasive particles is pumped through the jet orifice within the nozzle, and in the abrasive water jet, the abrasive particles are added to a high velocity stream of water after it is expressed through a jet orifice. To protect the seals and the pressure vessels, it is preferable to apply heating downstream of the UHP pump or the accumulator (for an intensifier pump). Examples of heating methods, individually or combined, include:

Wrap heating tapes 2 around the UHP tubing 1 upstream of the AWJ/ASJ nozzle 4.

Apply inductive heating 3 around the mixing tube 6 from which the jet 7 exits.

Place the target workpiece 8 on a heated plate 9.

Figure 2:
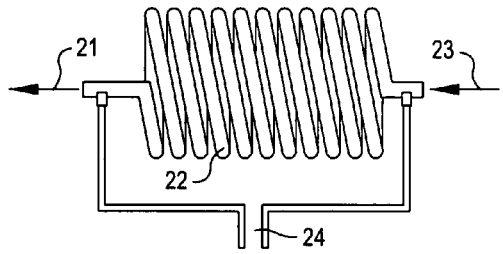
FIG. 2 shows a resistive method for heating the water.
Figure 3:
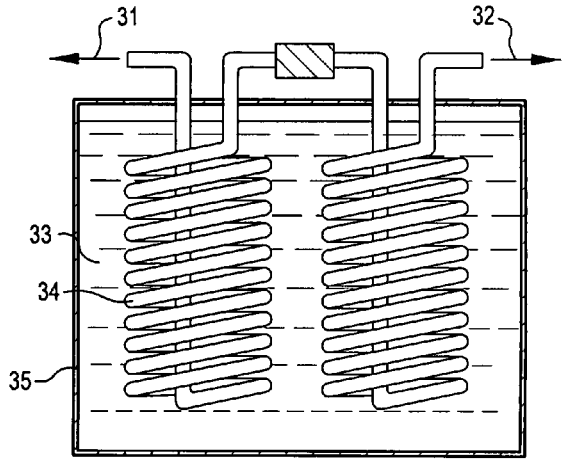
FIG. 3 shows a conductive method for heating the water.
Figure 4:
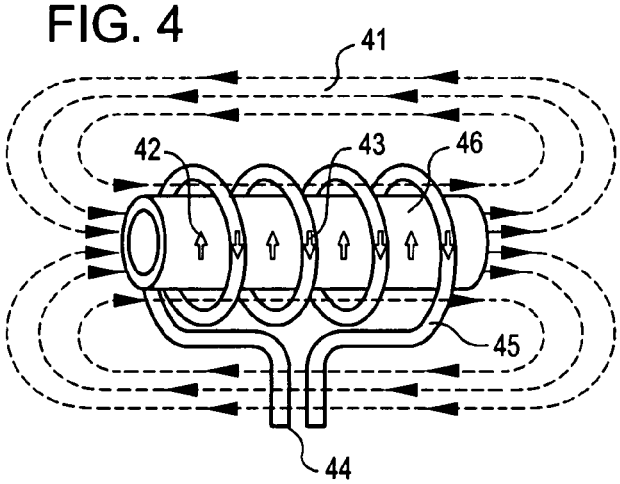
FIG. 4 shows an inductive method for heating the water.

Optional heating methods may also be used to superheat the water. FIGS. 2, 3, and 4 illustrate three such methods via resistive (FIG. 2), conductive (FIG. 3), and inductive (FIG. 4) heating. These methods are used to heat the water in a section of the high-pressure tubing just upstream of the nozzle. To increase the length of time that the water is heated as it passes through the pipe, the UHP tubing is bent into tightly wound coils.

As shown in FIG. 2, resistive heating is accomplished by applying AC current via power supply wires 24 to several coils 22 of stainless steel tubing between an inlet 23 to the tubing and an exit 21.

Alternatively, as shown in FIG. 3, the high-pressure coils 34 may be placed inside an electric melting pot 35 filled with a heat transfer fluid 33. The heaters in the melting pot raise the temperature of a heat transfer oil 33 in which the high-pressure coils are submerged. High pressure water or slurry enters the coils at 32 and exits the coils at 31.

As shown in FIG. 4, inductive heating may be applied to the guard of the mixing tube 46 within the nozzle assembly to achieve localized heating. An electric coil 45 is wrapped around the mixing tube 46 and an alternating current is applied to the wire ends 44, which induces an alternating magnetic field 41 which induces alternating currents shown by arrows 42 and 43 in the mixing tube 46 and its watery contents, heating them both. Water molecules, having dipolar moments, absorb high amounts of energy from oscillating electric fields that oscillate at the resonant frequency of the polar molecules, which is the frequency selected for microwave ovens for this reason. The same frequency is effective here for direct heating of the water molecules from the electric field and it may be applied with the same magnetron devices.

Figure 5:
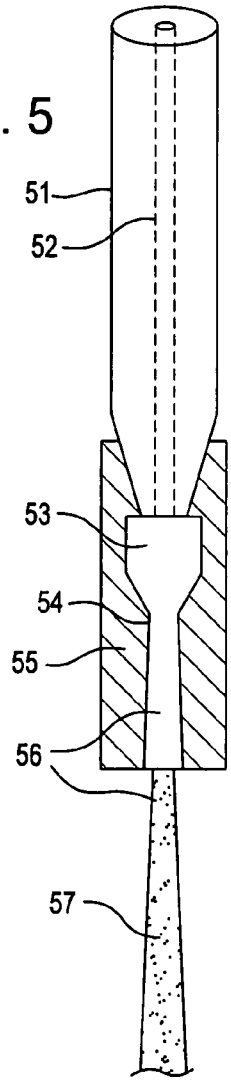
FIG. 5 shows a supersonic FAWJ acceleration nozzle attachment.

To take advantage of the FAWJ/FASJ, additional hardware devices may be attached to the mixing tube to achieve specific enhancements (FIG. 5). For example, if an objective is to take advantage of the expansion of the phase change as the water flashes to further accelerate the abrasive particles, it is preferable to have the water flash at the exit of the mixing tube 51. A device 55 consisting of an expanded cavity 53 followed by a convergent 54-divergent 56 (C-D) supersonic nozzle may be attached to the end of the mixing tube. The expanded cavity is designed to stimulate the jet 52 to flash. The flashed jet 57 consists of abrasives carried by a gaseous jet saturated with water vapors at an elevated temperature. As the greatly expanded jet moves through the supersonic nozzle, the jet accelerates in the convergent section of the nozzle, achieves a sonic speed at the throat of the nozzle, and further accelerates through the divergent section of the nozzle. The acceleration increases the material removal rate. The incorporation of the C-D nozzle 55 into the conventional FAWJ/FASJ nozzle takes advantage of a two-stage acceleration of the abrasives: first by the UHP superheated waterjet 52 followed by the flashing in which a part of the water changes into an ultrahigh-speed steam jet 57.

The described system will emulate the phase changing characteristics of the bulky, costly, hazardous, and technically challenging ACJ to enhance the performance of the UHP AWJ/ASJ in the following ways:

The FAWJ/FASJ will minimize the piercing pressure build-up inside the cavity of the blind hole as a part of the water evaporates and escapes the cavity as a gas. This greatly reduces the damage to the target workpiece, particularly for surface/subsurface damage of composites and delamination of laminates.

A large percentage of the water in the FAWJ/FASJ flashes before entering the cavity of the blind hole and gas can flow easily out of the hole, therefore reducing the wearing on the wall of the cavity by the abrasives carried by the otherwise strong return slurry, improving the uniformity of the hole diameter and reducing the anomaly of a relatively large entry hole diameter.

The FAWJ/FASJ can increase the abrasive speed via two-stage acceleration (accomplished with the convergent/divergent nozzle attachment), thus improving the material removal rate and machining efficiency of the FAWJ/FASJ (as compared with the AWJ)

The FAWJ/FASJ emulates the advantages of the ACJ for mitigating surface/subsurface damage of delicate materials and laminates at a considerably lower cost, is more portable, and is safer to operate and maintain.

Because many varying and different embodiments may be made within the scope of the inventive concept herein taught including equivalent structures or materials hereafter thought of, and because many modifications may be made in the embodiments herein detailed in accordance with the descriptive requirements of the law, it is to be understood that the details herein are to be interpreted as illustrative and not in a limiting sense, the invention being specified in the following claims.

What is claimed:

1. A jet cutting system using a hot liquid where a portion of the jet vaporizes from liquid to gas, comprising:

a. a reservoir configured to contain a fluid that is a liquid in a range of 0 degrees C. to 50 degrees C. and earth surface atmospheric pressures;

b. a pump configured to receive and pressurize the fluid to a pressure sufficient keep the fluid in liquid form at a temperature that would produce a gas within the range of earth surface atmospheric pressures;

c. a nozzle configured to receive the pressurized fluid and allow the fluid to be expressed in a jet into an atmosphere at a pressure within the range of earth surface atmospheric pressures; and d. a heater configured to heat the fluid after the fluid enters the nozzle, wherein the heater is configured to heat the fluid to a temperature that would produce a gas in the range of earth surface atmospheric pressures such that a substantial portion of the jet vaporizes after entering the nozzle.

2. The system of claim 1 wherein the nozzle has a length and vaporization commences within the length of the nozzle.

3. The system of claim 1 further comprising an expansion tube configured to accelerate the fluid jet with propulsion provided by expansion of the fluid as a portion of the fluid vaporizes.

4. The system of claim 1 further comprising an abrasive particles supply subsystem configured to add abrasive particles to the fluid before the jet strikes a workpiece.

5. The system of claim 4 where the abrasive particles supply subsystem is configured to add abrasive particles before the liquid enters the nozzle.

6. The system of claim 4 where the abrasive particles supply subsystem is configured to add abrasive particles after the liquid enters the nozzle.

7. The system of claim 1 wherein the heater is configured to heat the jet after it enters the nozzle and before it strikes a workpiece.

8. The system of claim 1 wherein the heater is configured to heat a workpiece which heats the jet as it strikes the workpiece.

9. The system of claim 1 wherein the heater includes a portion that is coupled between the pump and the reservoir.

10. The system of claim 1 wherein the fluid is essentially water.

11. A method in a fluid jet cutting system for reducing lateral pressure on side walls of cuts when piercing by using a vaporizing jet, comprising:

a. operating a jet cutting system comprising:

(i) a source of liquid fluid;

(ii) a pump configured to pressurize the liquid water to at least 100 atmospheres;

(iii) a heater configured to superheat the pressurized liquid fluid after the fluid enters a nozzle,; and (iv) the nozzle configured to convert the pressure of the superheated liquid fluid to a high velocity jet; and b. moving at least one of the nozzle or a workpiece to make a piercing cut into the workpiece.

12. The method of claim 11 wherein the nozzle has a length and vaporization commences within the length of the nozzle.

13. The method of claim 11, wherein the jet cutting system further comprises:

an expansion tube coupled to receive the high velocity jet and accelerate the fluid jet with propulsion provided by expansion of the fluid as a portion of the fluid vaporizes.

14. The method of claim 11 wherein the jet cutting system further comprises;

a secondary nozzle that accelerates the fluid jet with propulsion provided by expansion of the fluid as a portion of the fluid vaporizes.

15. The method of claim 11 wherein the system further comprises an abrasive particles supply subsystem that adds abrasive particles to the fluid before the jet strikes the workpiece.

16. The method of claim 15 where the abrasive particles supply subsystem adds abrasive particles before the liquid enters the nozzle.

17. The method of claim 15 where the abrasive particles supply subsystem adds abrasive particles after the liquid enters the nozzle.

18. The method of claim 11 wherein:

(a) the pressure of the atmosphere is within a range of earth surface atmospheric pressures, (b) the fluid is a liquid in a range of 0 degrees C. to 50 degrees C. and earth surface atmospheric pressures, and (c) the heater heats the fluid after the fluid enters the nozzle to a temperature that would be a gas in the range of earth surface atmospheric pressures but is a liquid under pressure of the pump, such that a portion of the fluid vaporizes after entering the nozzle.

19. The method of claim 11 wherein the fluid is essentially water.

20. A jet cutting system using hot liquid water where a portion of the jet vaporizes from liquid to gas, comprising:

a. a reservoir containing liquid water; coupled to, such that the water may flow into b. a pump that pressurizes the water to a pressure sufficient keep the water in liquid form at a temperature that would produce a gas within the range of earth surface atmospheric pressures; coupled to, such that the water may flow into c. a nozzle that allows the water to be expressed in a jet into an atmosphere at a pressure within the range of earth surface atmospheric pressures; and further comprising:

d. a heater that heats the water after the water enters the nozzle, the heater being configured to heat the water to a temperature that would produce a gas in the range of earth surface atmospheric pressures such that a substantial portion of the jet vaporizes after entering the nozzle.

21. The system of claim 20 wherein the nozzle has a length and vaporization commences within the length of the nozzle.

22. The system of claim 20 further comprising an expansion tube that accelerates the water jet with propulsion provided by expansion of the water as a portion of the water vaporizes.

23. The system of claim 20 further comprising an abrasive particles supply subsystem that adds abrasive particles to the water before the jet strikes a workpiece.

24. The system of claim 23 where the abrasive particles supply subsystem adds abrasive particles before the water enters the nozzle.

25. The system of claim 23 where the abrasive particles supply subsystem adds abrasive particles after the water enters the nozzle.

26. The system of claim 20 wherein the heater heats the jet after it enters the nozzle and before it strikes a workpiece.

27. The system of claim 20 wherein the heater heats a workpiece which heats the jet as it strikes the workpiece.

* * * * *

UNITED STATES PATENT AND TRADEMARK OFFICE

CERTIFICATE OF CORRECTION

PATENT NO. : 7,815,490 B2
APPLICATION NO. : 11/818272
DATED : October 19, 2010
INVENTOR(S) : Peter Liu It is certified that error appears in the above-identified patent and that said Letters Patent is hereby corrected as shown below:

On the first page of the Specification, after the first paragraph, in column 1, at line 8, insert the paragraph below:

-- ACKNOWLEDGEMENT OF GOVERNMENT SUPPORT

This invention was made with government support under National Science Foundation Grant No. 0620277. The Government has certain rights in this invention. --

Signed and Sealed this
Seventeenth Day of May, 2016

Michelle K. Lee

Michelle K. Lee
*Director of the United States Patent and Trademark Office*